US005335913A

United States Patent [19]

White

[11] Patent Number: 5,335,913

[45] Date of Patent: Aug. 9, 1994

[54] GOLF CLUB

[76] Inventor: Robert W. D. White, 9 Summers Way, Knutsford, Cheshire WA16 9AQ, United Kingdom

[21] Appl. No.: 56,387

[22] Filed: May 4, 1993

[30] Foreign Application Priority Data

May 21, 1992 [GB] United Kingdom ..... 9210886

[51] Int. Cl.[5] ..... A63B 53/02; A63B 53/04

[52] U.S. Cl. ..... 273/164.1; 273/167 A; 273/79; 273/171; 273/80.2

[58] Field of Search ..... 273/77 R, 167 R, 167 A, 273/167 D, 167 E, 167 F, 167 G, 167 J, 173, 174, 164.1, 162 R, 80.1, 80.2, 79, 168, 193 R, 194 R, 194 A, 169; D21/217, 219

[56] References Cited

U.S. PATENT DOCUMENTS

| | | | |
|---|---|---|---|
| 1,531,821 | 3/1925 | Scott | 273/167 A |
| 2,155,830 | 4/1939 | Howard | 273/79 |
| 2,222,534 | 11/1940 | Harris | 273/79 |
| 2,708,579 | 5/1955 | Hugman | 273/80.2 |
| 2,932,515 | 4/1960 | May | 273/80.1 |
| 3,408,074 | 10/1968 | Antonious | 273/169 X |
| 3,516,674 | 6/1970 | Scarborough | 273/169 |
| 3,680,868 | 8/1972 | Jacob | 273/167 A X |
| 3,806,129 | 4/1974 | Burrows | 273/167 A X |
| 3,955,819 | 5/1976 | Yokich . | |
| 4,484,746 | 11/1984 | Brill | 273/167 A |
| 4,714,252 | 12/1987 | Roraback . | |
| 4,832,344 | 5/1989 | Werner . | |
| 4,921,253 | 5/1990 | Tesori . | |
| 4,962,931 | 10/1990 | Jazdzyk | 273/164.1 |

FOREIGN PATENT DOCUMENTS

| | | | |
|---|---|---|---|
| 652592 | 4/1951 | United Kingdom . | |
| 1267624 | 3/1972 | United Kingdom . | |
| 2124090 | 2/1984 | United Kingdom | 273/167 A |

*Primary Examiner*—Mark S. Graham
*Assistant Examiner*—Sebastiano Passaniti
*Attorney, Agent, or Firm*—Oblon, Spivak, McClelland, Maier & Neustadt

[57] ABSTRACT

A golf club of the putter type has a shaft attached to a head substantially centrally and inclined towards a heel at an angle of about 10° to the vertical. The head is formed of a body part providing a bottom surface and a blade providing a front surface, the surfaces being mutually perpendicular. The blade is removably secured to the body part by screws which pass through the body part and into respective ones of several tapped holes in the blade so that the position of the blade can be adjusted longitudinally of the body part. Two protrusions with convexly curved fore and aft profiles are provided on the bottom surface on opposed sides of the fore and aft extending centerline.

13 Claims, 1 Drawing Sheet

FIG. 1
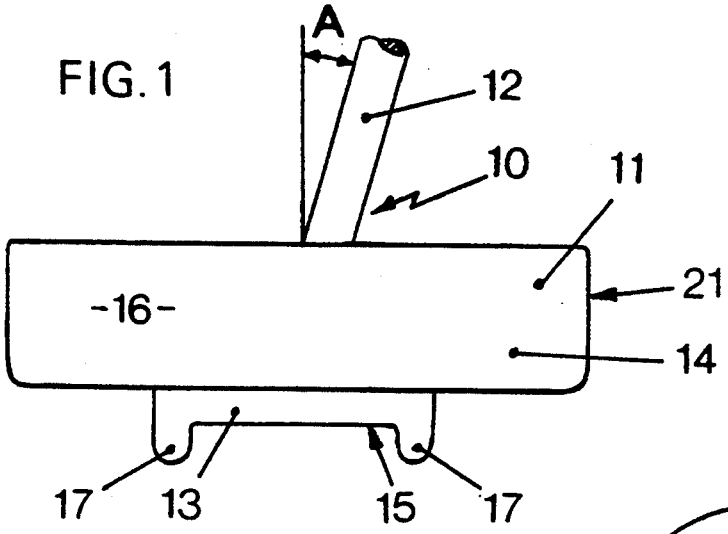
FIG. 2
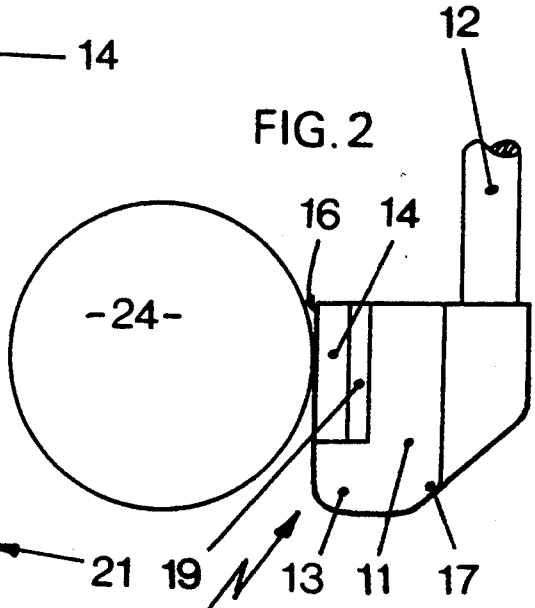
FIG. 3
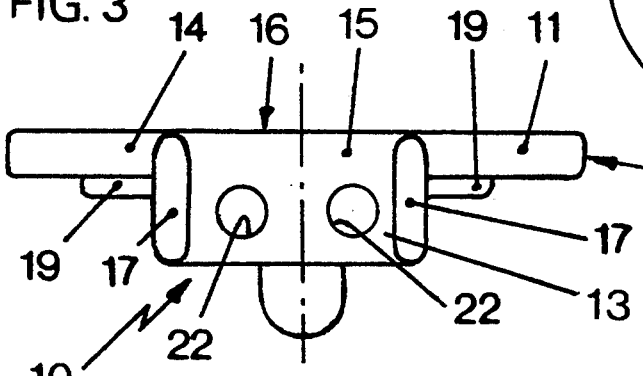
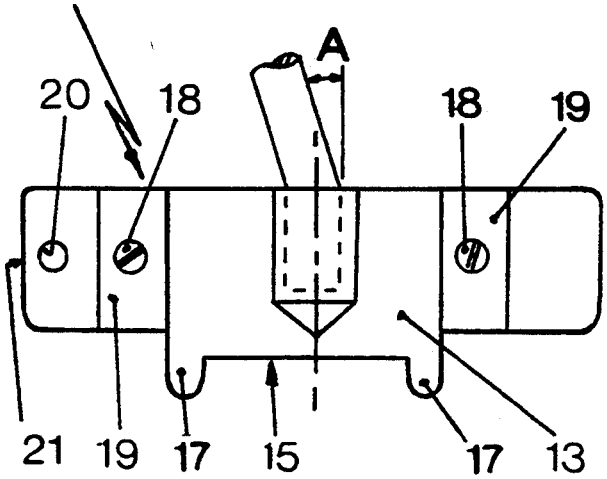
FIG. 4
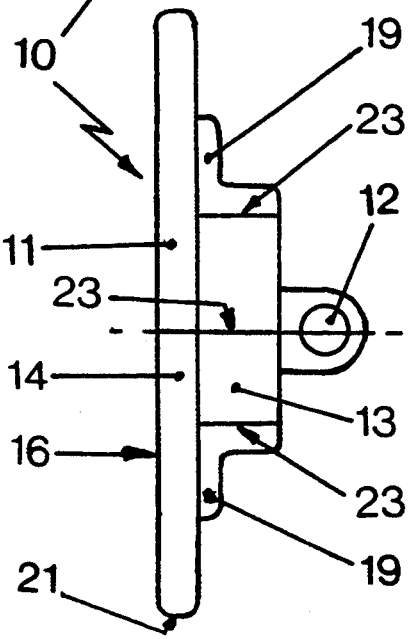
FIG. 5

GOLF CLUB

FIELD OF THE INVENTION

This invention relates to golf clubs, and in particular to golf clubs of the type generally known as "putters".

BACKGROUND OF THE INVENTION

When a putter is addressing or striking a ball, the front face of the putter is substantially vertical and the shaft of the club lies substantially in a vertical plane. However, for many golfers, particularly inexperienced players, it is not easy to apply an accurate, smooth and delicate putting strike to the ball, since it is the top of the head of the club which strikes the ball, and the head of the club may stub the ground on either the backswing or the forward stroke. It is also not an easy task to strike the ball with the desired top, back, or no spin as might be required in the various circumstances met by the golfer.

SUMMARY OF THE INVENTION

It is an object of the present invention to provide a golf club of the putter type which overcomes the abovementioned disadvantages at least to an appreciable extent.

The invention provides a golf club of the putter type having a head and a shaft attached thereto, the head having a front face and a bottom surface which are generally planar and substantially mutually perpendicular, wherein at least one depending protrusion is provided on the bottom surface to extend out of the plane thereof.

Preferably two mutually spaced protrusions are provided, in which case the protrusions may be equally spaced from the longitudinal center line of the bottom surface. The or each protrusion may have a profile which is curved in a fore and aft direction.

The head may comprise a body part and a blade, which are detachably secured to each other. In that case the blade may be securable to the body part in any one of a plurality of positions spaced longitudinally along the body part. The shaft may be attached to the body part, and may extent at an angle of between 0° and 15°, preferably 10°, to vertical, directed towards the heel of the head, when the head is in a horizontal disposition.

At least one recess may be provided in the head for receiving a weight therein whereby the weight of the head may be varied. Two such recesses may be provided. At least one marking may be provided on the upper surface of the head, which marking is substantially perpendicular to the plane of the front face of the head to provide a fore and aft alignment for the club.

BRIEF DESCRIPTION OF THE DRAWINGS

One embodiment of golf club in accordance with the invention will now be further described with reference to the accompanying drawing in which:

FIG. 1 is a front elevation.

FIG. 2 is a side elevation of the club in the ball-addressing position.

FIG. 3 is an bottom plan view.

FIG. 4 is a rear elevation, and

FIG. 5 is a plan view.

DESCRIPTION OF THE PREFERRED EMBODIMENTS

Referring now to the Figures, there is shown a golf club 10 of the putter type, comprising a head 11 and a shaft 12 attached thereto. The head 11 comprises a body part 13 and a blade 14, the former providing a generally planar bottom surface 15 of the head 11, and the latter providing a planar front face 16. The bottom surface 15 and the front face 16 are generally mutually perpendicular. Two depending protrusions 17 are provided on the body part 13 to extend out of the plane of the bottom surface 15, which protrusions 17 convexly curved in the fore and aft direction, as seen in FIG. 2. The protrusions 17 are equi-spaced on opposed sides of the longitudinal center line C of the bottom surface 15 and body part 13.

The blade 14 is secured to the body part 13 by means of two screws 18 which pass through two flanges 19 provided on the body part 13 and into respective ones of several tapped holes 20 provided in the blade 14. In the configuration shown in the Figures, the blade 14 is disposed substantially centrally of the body part 13, and therefore substantially centrally with respect to the lower end of the shaft 12. The shaft 12 extends substantially vertically when viewed from the side of the club 10, as shown in FIG. 2, but is inclined at an angle A of approximately 10° to the vertical towards the heel 21 of the head 11 when viewed from the front or rear of the club 10, as shown in FIGS. 1 and 4. If desired, the blade 14 may be separated from the body part 13 and replaced with the screws 18 in an alternative combination of two of the holes 20, whereby the lower end of the shaft 12 is offset longitudinally from the center line C towards the heel 21. The provision of several holes 20 in the blade 14 can provide more than two alternative locations of the blade 14 relative to the body part 13.

Also provided in the body part 13 are two recesses 22 into which differing weights (not shown) may be placed to vary the weight of the head 11 if desired. In addition, markings 23 are provided, on the upper surface of the body part 13, which are perpendicular to the plane of the front face 16, to facilitate alignment of the club 10 relative to the direction in which it is intended to propel the ball 24. The provision of protrusions 17 on the bottom surface 15 allow for minimum contact between the club 10 and the ground, thereby enabling a player to make a smoother and more delicate stroke to the ball 24 than with a conventional putter. In addition, the protrusions 17 raise the blade 14 relative to the ground so that the center of the blade 14 strikes the ball 24, instead of the top of the blade as occurs with conventional putters. A more accurate striking of the ball 24 is thereby produced. Since the fore and aft profile of the protrusions 17 is convexly curved, the risk of stubbing the club 10 on the ground during the backstroke or the forward stroke is less than with conventional putters. This feature also facilitates the holding of the club 10 with the front face 16 inclined to vertical at the moment of striking the ball 24, either at a negative or positive angle, so as to impart top spin or back spin respectively to the ball 24, as desired. For any particular golfer, his or her preferred relative disposition of the shaft 12 and the blade 14 can be achieved by choosing the holes 20 into which the screws 18 are fitted, so that the club 10 may be center-shafted as shown in the Figures, or have the shaft 12 disposed in a more conventional position nearer to the heel 21. With the provision of means for adjustment of the weight of the head 11, and for the alignment of the head 11 relative to the direction of intended striking of the ball 24, the club 10 of the present invention provides a considerable improvement over conventional putters. The blade 14 and the body part 13 may be made of any suitable material, for example stainless steel, polished brass or other metal, and if the two parts are made of materials of different color, different aesthetic effects can be produced.

I claim:

1. A golf club of the putter type, which comprises:

a head;

a shaft attached to the head, the head having a front face for striking a ball and a bottom surface wherein the front face and the bottom surface are generally planar and are substantially mutually perpendicular, and at least one depending protrusion provided on the bottom surface which extends out of the plane thereof, the head including a body part and a blade which are detachably secured to each other and wherein the front face comprises a surface of the blade.

2. A golf club according to claim 1, wherein said at least one protrusion comprises two protrusions mutually spaced longitudinally of the head.

3. A golf club according to claim 2, wherein the bottom surface has a fore and aft extending longitudinally disposed centerline and the protrusions are equally spaced on opposed sides of the centerline.

4. A golf club according to claim 1, wherein the at least one protrusion has a profile which is curved in a fore and aft direction.

5. A golf club according to claim 1, wherein the blade is secured to the body part in one of a plurality of positions spaced longitudinally of the body part.

6. A golf club according to claim 5, wherein the blade has a plurality of tapped holes provided therein and is secured to the body part by screws which pass through the body part and into respective ones of the plurality of holes.

7. A golf club according to claim 1, wherein the shaft is secured to the body part.

8. A golf club according to claim 7, wherein the shaft is secured to the body part substantially centrally thereof.

9. A golf club according to claim 8, wherein the head has a heel and the shaft extends at an angle of between 0° and 15° to the vertical directed towards the heel when the head is horizontal.

10. A golf club according to claim 9, wherein the shaft extends at an angle of substantially 10° to the vertical directed towards the heel of the head when the head is horizontal.

11. A golf club according to claim 1, wherein at least one recess is provided in the head and wherein a weight is positioned in the at least one recess so as to vary the weight of the head.

12. A golf club according to claim 11, wherein said at least one recess comprises two recesses.

13. A golf club according to claim 1, wherein at least one marking is provided on the upper surface of the head, which marking is substantially perpendicular to the plane of the front face of the head to provide a fore and aft alignment for the club.

* * * * *